United States Patent [19]

Hoelzl

[11] Patent Number: 4,750,372

[45] Date of Patent: Jun. 14, 1988

[54] FATIGUE INDICATOR

[75] Inventor: Klaus Hoelzl, Vienna, Austria

[73] Assignee: TMC Corporation, Baar, Switzerland

[21] Appl. No.: 943,968

[22] Filed: Dec. 19, 1986

[30] Foreign Application Priority Data

Dec. 23, 1985 [AT] Austria ..... 3738/85

[51] Int. Cl.[4] ..... G01L 5/00; G01D 1/14

[52] U.S. Cl. ..... 73/862.53; 73/764; 128/779

[58] Field of Search ..... 73/764, 862.51, 862.53, 73/862.54, 379, 865.1, 865.4; 280/611, 612, 613; 128/779, 774; 340/573, 665

[56] References Cited

U.S. PATENT DOCUMENTS 3,777,555 12/1973 Petrisko et al. ..... 73/764
4,031,366 6/1977 Hartung ..... 73/577 X
4,156,534 8/1977 Salomon .
4,387,307 6/1983 D'Antonio ..... 280/613 X

*Primary Examiner*—Charles A. Ruehl
*Attorney, Agent, or Firm*—Flynn, Thiel, Boutell & Tanis

[57] ABSTRACT

A device for detecting the forces acting onto a ski binding or a shoe held in such a binding comprising at least one feeler emitting electrical signals in dependency from the occurring forces and an evaluating circuit processing the signals. In order to be able to calculate the state of fatigue of the skier and, if necessary, the condition of the binding, it is provided that an integrator circuit constructed as a counter is connected after the evaluating circuit, which integrator circuit is connected to an indicating device and which can be reset merely by means of a manually operable switching device. The counter can thereby count either signals of the evaluating circuit corresponding with predetermined impacts, or digital signals corresponding with impacts having an energy content, or signals which correspond with those impacts, the rising and dropping speed of which exceed a limit value.

6 Claims, 4 Drawing Sheets

1a
1b
2a
2b
3a
3b
3c
3'
4
5
6
7
8
9
10
11
12
R21
R22
20
20b
R21a
R31
R32
R33
R34
R35
R36
R37
R38
R39
30
30a
30b
30c
D31
D32
T31
C31
R41
R42
R43
R44
R45
40
47
D46
62
R63
61
91
92
121
122
R112
111

FATIGUE INDICATOR

FIELD OF THE INVENTION

The invention relates to a device for detecting the forces acting onto a ski binding or a shoe held by the ski binding, which device has at least one feeler emitting electric signals in dependency from the occurring forces and an evaluating circuit for processing the signals.

BACKGROUND OF THE INVENTION

In a known binding with force feelers emitting electric signals, the evaluation of the detected forces occurs exclusively in view of a meeting of release criteria, whereby upon reaching the release criteria, the jaw of the binding is released controlled by the evaluating circuit.

The skier becoming tired encounters an increased risk of injury during skiing. The skier's motions become rigid, thus the ligaments, joints and the muscles are increasingly stressed. Also a rigid skiing manner results in an increased stress on the binding.

The goal of the invention is to provide a device of the abovementioned type, which can receive information regarding the state of fatigue of the skier.

This is attained inventively by an integrator circuit being connected after the evaluating circuit, which integrator circuit is connected to an indicating device and which can be reset by means of a manually operable switching device. This measure makes it possible to indirectly determine the fatigue of the skier. It has been proven that the impacts occurring during skiing stress both the skier himself and also the binding, the summation of signals corresponding with the impacts estimating or determining the necessity of servicing of the binding.

The impacts, which during skiing load the human leg and thus must be absorbed by the leg, depend both on outer, that is objectively nonvariable, and also on inner, subjective factors influenced by the skier. They are thus an indicator of the degree of the fatigue of the skier. Even though inner tenseness and rigidness, for example, due to psychological moments of fear, or due to poor skiing skills, and others of course also contribute to fatigue and are not directly detected by the suggested measures, they are nevertheless indirectly detected, since such tenseness and rigidness do permit the outside influence factors, like slope condition etc. to penetrate the human leg and on into the body much more direct and noncushioned. The reason for this is that we are dealing here with a typical coupling problem between outer and inner influencing factors: the resulting impact course is in the case of such problems determined by both factor groups. Thus, a rigid, nonexperienced skier skiing over the same track irregularities will indicate narrow peaks with high amplitude, whereas a good, experienced skier will indicate only elongated impacts with small amplitude, from which only small stresses on the skier and the binding result.

According to a characteristic of the invention, it can be provided that the integrator circuit connected to the evaluating circuit is constructed as a counter, which counts the signals of the evaluating circuit, which signals correspond with the impacts acting onto the binding or the shoe, which impacts, if necessary, exceed an adjustable limit value. This measure results in structural respects in a very simple solution. Thus, impacts can be detected by uncomplicated evaluating circuits. Furthermore, an integrator with a simple design results therefrom. Reaching a specific, possibly adjustable value indicates then to the skier that his fatigue has already reached a dangerous stage.

Furthermore, it can be provided that the integrator circuit connected after the evaluating circuit is constructed as a counter, which counts the digital signals coming from the evaluating circuit and corresponding with the impacts having an energy content lying above an, if necessary, adjustable limit value. The signals corresponding with the affecting forces are thereby integrated over time in the evaluating circuit, whereby, if necessary, signals lying below a specific amplitude value are suppressed and the integrated signals are converted into digital signals. This permits a relatively precise detecting of the stresses acting onto the skier and the binding.

In order to be able to detect in particular those impacts which occur mainly in a not adjusted, rigid skiing method and which are distinguished through a rather needleshaped course of the signals corresponding with the acting forces, it can be provided that the integrator circuit connected after the evaluating circuit is constructed as a counter, which counts the signals of the evaluating circuit which correspond with those impacts, whose rising and dropping speed exceeds an, if necessary, adjustable limit value. The evaluating circuit can thereby either differentiate between the arriving signals and thus determine the steepness of the arriving signals or the evaluating circuit determines the width of the arriving signals at a specific magnitude of the amplitudes. This too permits a detecting of relatively sharp signals having a high amplitude.

A particularly preferred embodiment of the invention can provide that the integrator circuit connected after the evaluating circuit is formed by a divider and at least one counter connected after the divider, which counter can be connected to an indicating device and can be read into same, whereby preferably the divider is connected to two parallel connected counters, which can be connected selectively to the indicating device through a selector switch, whereby one of the counters can be reset by the manually operable switching device and the other counter is connected to a digital comparator, the second input of which is connected to a limit-value transmitter and the output of which is connected to a further indicating device. The latter measures accomplish a separation of the indications regarding the fatigue condition of the skier and the condition of the binding. This makes it also possible to provide only for one counter a resetting device operable by the user. Thus, it is possible to reset, for example daily, the counter related to the skier, whereas the counter related to the binding can be reset only during servicing of the binding with the necessity of servicing being indicated by a separate indicating device.

BRIEF DESCRIPTION OF THE DRAWINGS

The invention will now be discussed in greater detail with reference to the drawings in which.

Figure 1:
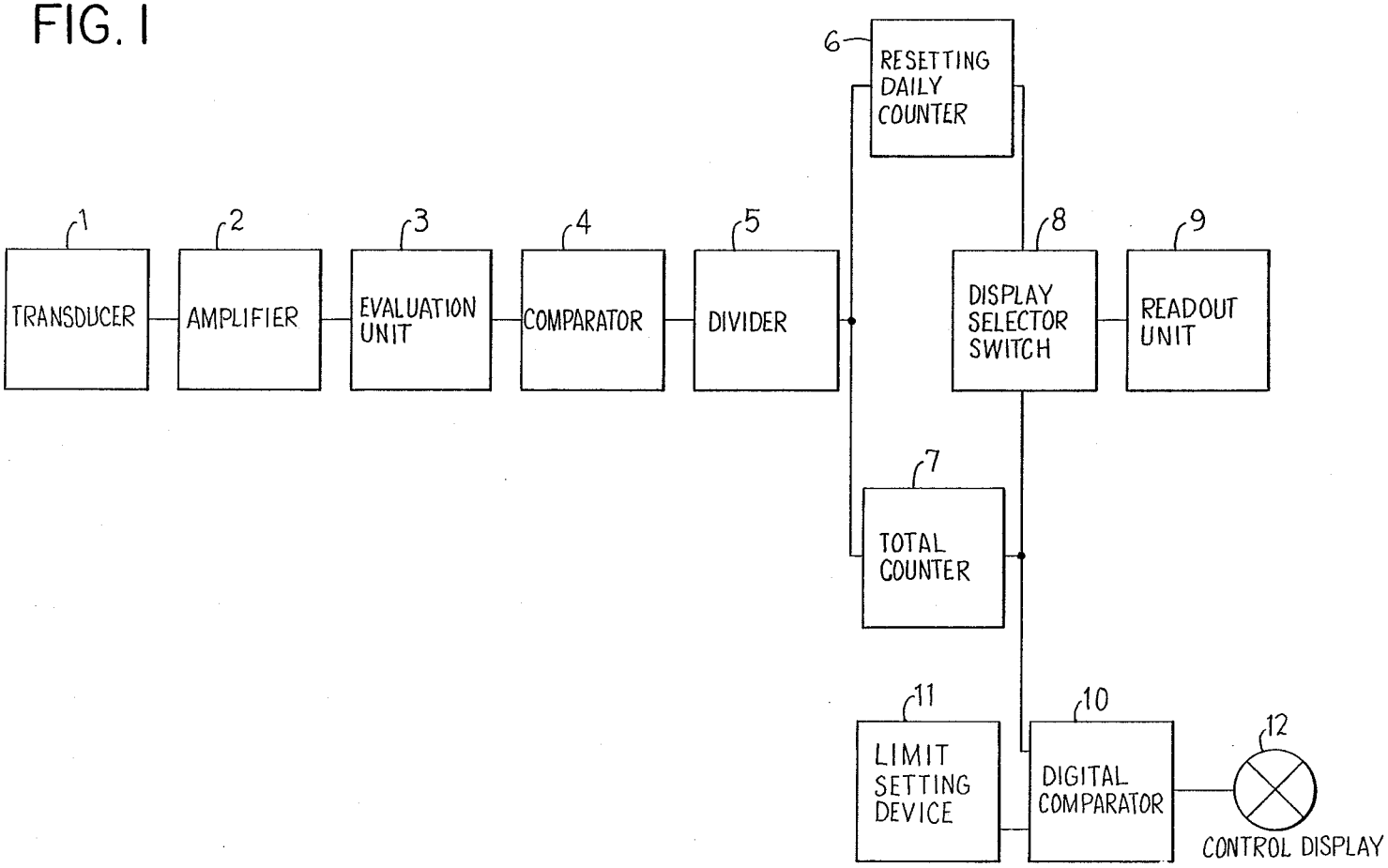
FIG. 1 is an electrical schematic block diagram of a preferred embodiment of the invention.

The forces acting onto the binding and thus onto the skier are converted into electric signals in the force receiver 1. The force receiver can thereby be formed by resistive wire strains glued onto a flexural bar, by an acceleration receiver, by piezo-electric crystals or another pressure-absorbing material. Further possibilities of construction for a force receiver consist for example in the arrangement of an oscillating beam coupled with an electromagnet, a field-effect receiver or a capacitive receiver.

The signals of the receiver 1 are fed to an amplifier 2. The amplifier is designed, depending on the receiver, either as an electro-meter amplifier 2*a* or as a difference amplifier 2*b* (for bridge connection of resistance strain gauges). The output signal of the amplifier 2 is fed to an evaluating circuit 3. The output of the evaluating circuit is connected to the input of a comparator circuit 4. If the output voltage of the evaluating circuit 3 exceeds a limit value adjusted in the comparator circuit 4 n-times, then the resettable day counters 6 and the total counter 7 are increased by 1; n is thereby the ratio of division of the divider 5. The count of the day counter 6 or of the total counter 7 can be indicated with the indicating switch 8 on the indicating unit 9.

The day counter 6 is connected to a resetting device manually operable by the user. The resetting device can for example be formed by a simple feeler. This counter 6 serves therefore as an indicator regarding the fatiguing of the skier. Thus, reaching a specific indicating value can be taken as a hint of a substantial amount of fatigue.

The output of the total counter 7 is furthermore connected to a digital comparator 10 which, upon exceeding the count corresponding with the digital limit-value emitter 11, activates the indicating device 12 and thus indicates that the binding should be serviced. Various designs are provided for the evaluating circuit 3 depending on the evaluating criteria:

- Exceeding or falling below a specific value of the amplitude of the receiver signal.
- Exceeding a specific positive or negative amplitude-time-surface corresponding with the integration of the positive or negative sensor signal above the time.
- Exceeding a certain steepness of the receiver-signal increase: suitably differentiating the sensor signal.

Of course it would also be possible to use a combination of the above criteria.

Figure 2:
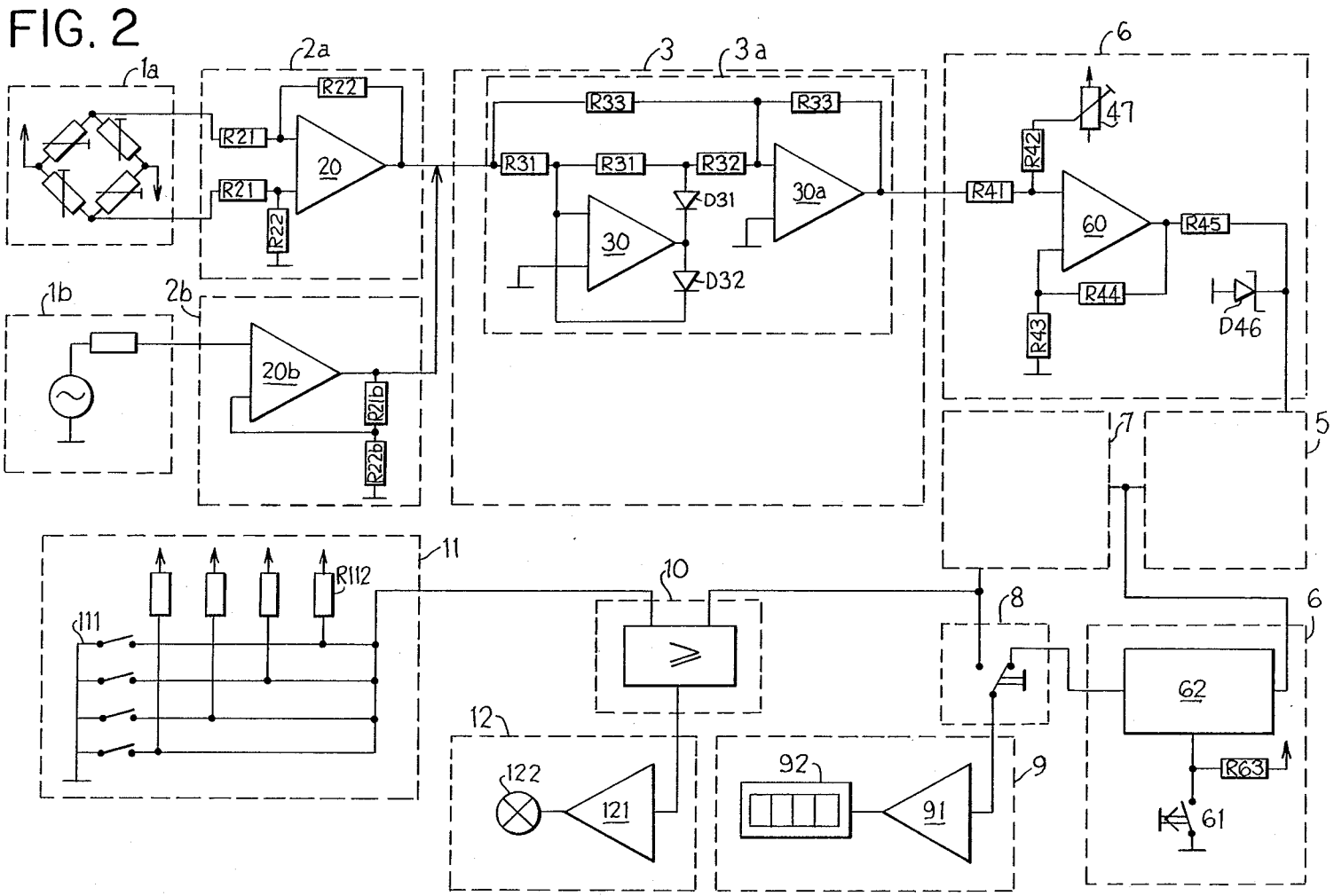
FIGS. 2 to 4 are each an electrical schematic diagram showing variations in circuitry utilized in the block diagram of FIG. 1.
Figure 3:
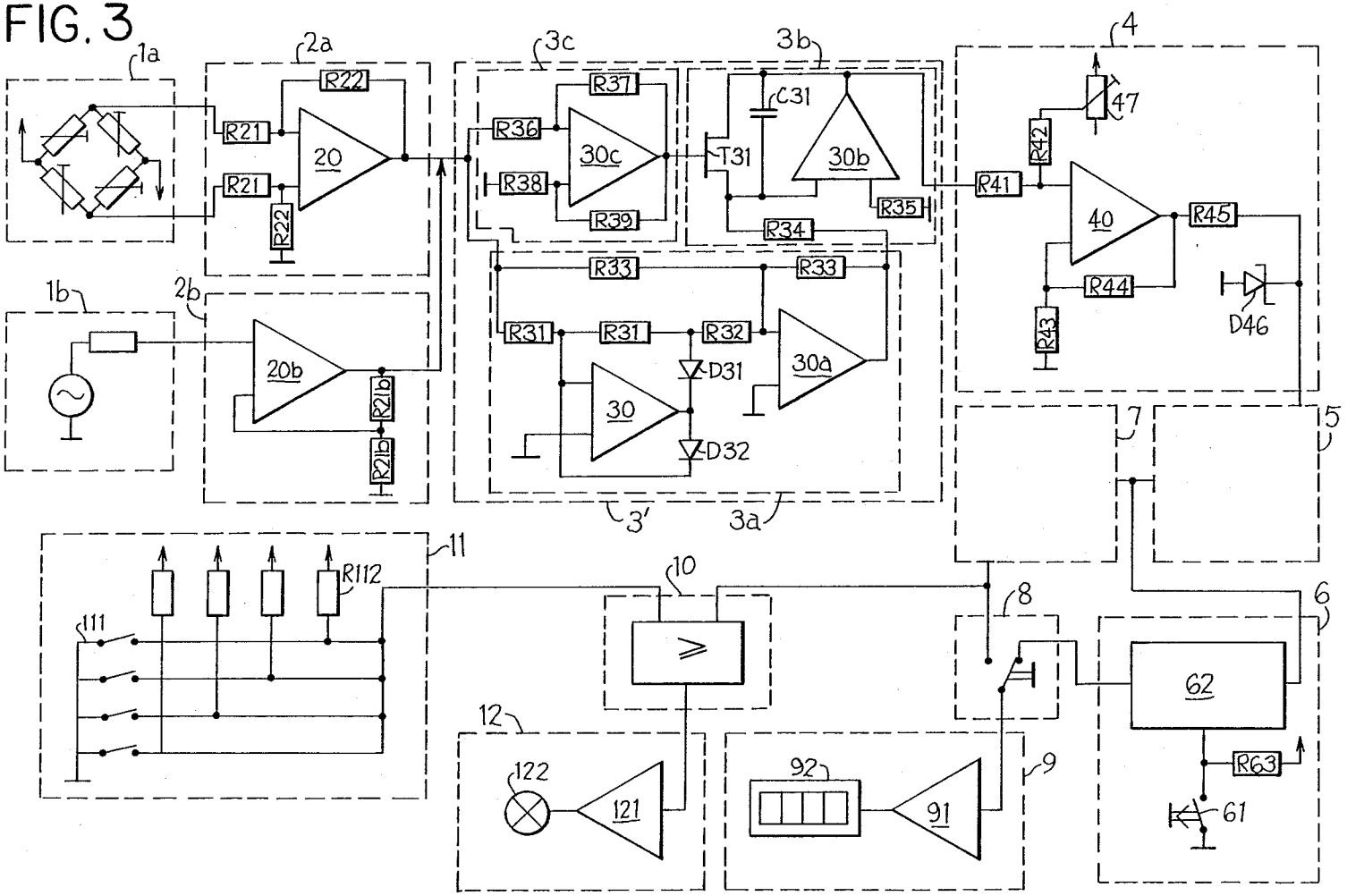
Figure 4:
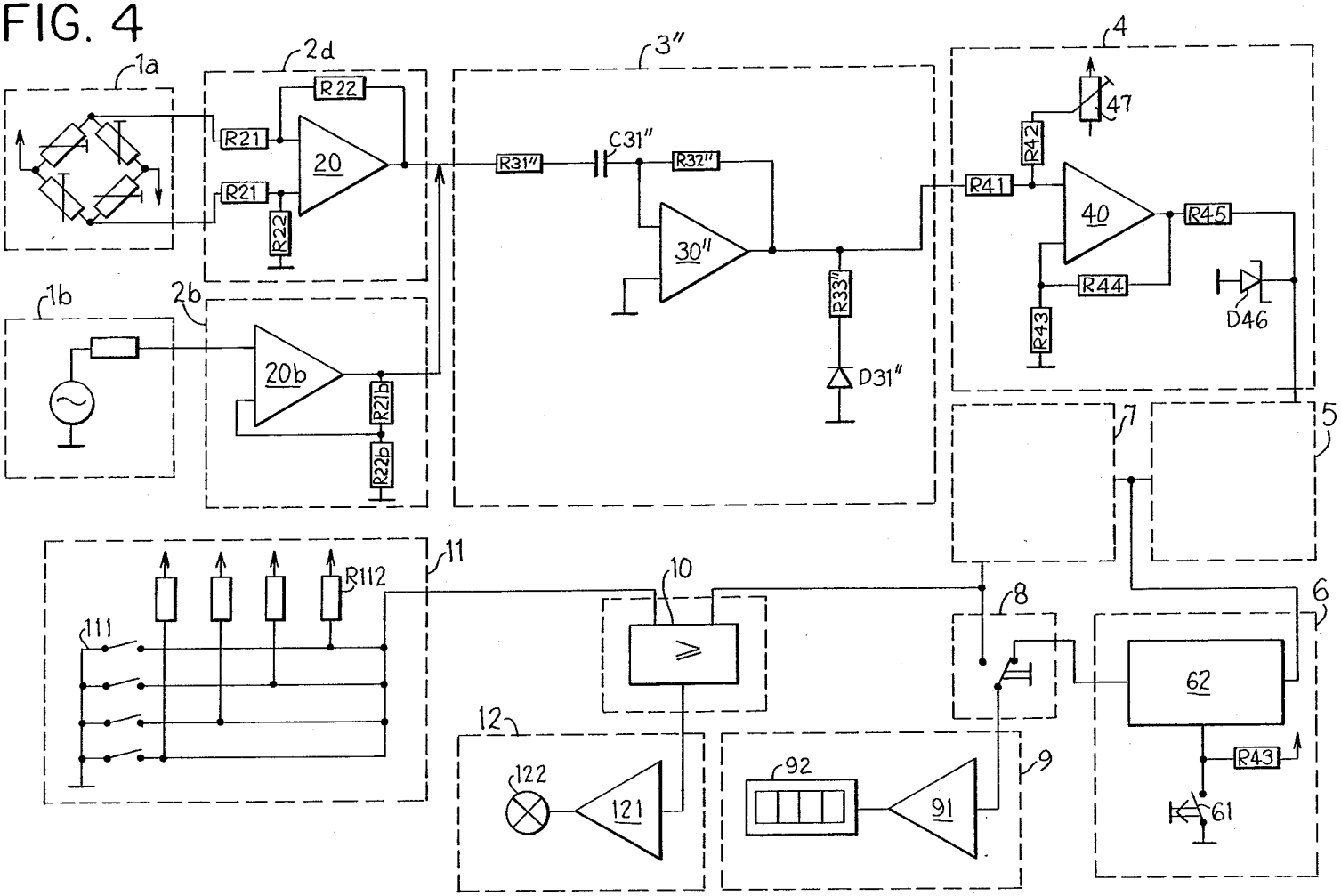

Possible embodiments of the various parts are illustrated in FIGS. 2 to 4. Resistors with identical values have in all embodiments the same reference numerals. The individual embodiments according to FIGS. 2 to 4 differ only in the different design of the evaluating circuit 3. Futhermore, FIGS. 2 to 4 each contain two modifications for the receiver 1 and the amplifier 2.

FIG. 2 shows: The receiver signal passes through the resistors R21 and R22 to the amplifier 20. The amplification is determined by the relationship of the resistor values R22/R21. An electrometer amplifier 2*b* can be used with the amplifier 20*b* and with the amplification (1+R21b/R22b) for receivers with mass-related voltage signals 1*b*. The output of the amplifier circuit 2 is connected to the input of the rectifier circuit 3*a*, which consists of the resistors R31, R32, R33, the amplifiers 30, 30*a* and the diodes D31/D32. The rectifier 3*a* forms the evaluating circuit 3.

The comparator circuit 4 contains a comparator 40, the input of which is connected through the resistor R41 to the output of the evaluating circuit 3 and through the resistor R42 to the threshold value potentiometer 47. The resistors R43, R44 determine the hysteresis of the comparator circuit 4. The limit value for the reaction of the comparator circuit 4 is adjusted with the threshold value potentiometer 47. The resistor R45 and the Zener diode D46 can be provided for the possibly needed adjusting to the input level of the following logic. The comparator circuit 4 delivers during each exceeding of the adjusted limit value an impulse to the output. The impulses are added up to a desired number in the part 5. If this number is exceeded, an impulse occurs at the output of the part 5 and the counting operation starts over again.

The dividing impulses are added in the day counter 6, consisting of the counter building block 62 and the resetting device, which in the simplest case consists of a key 61 and a pullup resistor R63, and in the total counter 7 and can be read with the indicating selector switch 8 selectively on the indicating unit 9 consisting of the indicating driver 91 and the indicator 92. The day counter 6 can be reset with the key 61. The values delivered by the day counter 6 are kept added up in the total counter 7.

The control indicator 12, consisting of the indicating driver 121 and the light 122, is activated, when the indicated number of the total counter 7 exceeds the desired value adjusted in the digital limit-value transmitter 11, which can consist for example of a series of switches 111 and of a pullup-resistance network R112. The count of the total counter 7 is for this compared in the digital comparator 10 with the desired value in the digital limit-value transmitter 11. This function can easily be realized by the indication of the counter overflow by the total counter 7. The so far described circuit counts all sensor values having a magnitude above a certain value.

The evaluating circuit 3' is further broadened by an integrator circuit 3*b* and a zero-point switch 3*c* in the embodiment according to FIG. 3. The integrator circuit 3*b* thereby consists of an operation amplifier 30*b*, the resistors E34, R35 and the capacitor C31 and the switch T31. The zero-point switch 3*c* has a comparator 30*c* and the resistors R36, R37, R38, R39. This embodiment is thus designed for an exceeding of a specific positive or negative amplitude-time-area corresponding with the integration of the positive or negative sensor signal beyond the time.

In the embodiment according to FIG. 4, in which an exceeding of a certain steepness of the receiver-signal increase is taken into consideration, the evaluating circuit 3'' is designed as a differentiator, which consists of an operation amplifier 30'', the resistors R31'', R32'' and the capacitor C31''. The resistor R33'' and the diode D31'' discharge output signals pursuant to dropping flanks in the sensor signal in accordance with mass.

The embodiments of the invention in which an exclusive property or privilege is claimed are defined as follows:

1. In a device for detecting the forces which act onto a ski binding or a shoe held in such a binding, said device having at least one feeler emitting electric signals in dependency from occurring forces and an evaluating circuit processing said signals, the improvement comprising an integrator circuit connected after the evaluating circuit, which integrator circuit is connected to an indicating device and which can be reset only by means of a manually operable switching device.

2. The device according to claim 1, wherein the integrator circuit connected to the evaluating circuit is constructed as a counter which counts the signals of the evaluating circuit, which signals correspond with the impacts acting onto the binding or the shoe, and, if necessary, exceeding an adjustable limit value.

3. The device according to claim 1, wherein the integrator circuit connected after the evaluating circuit is constructed as a counter which counts the digital signals coming from the evaluating circuit and corresponding with the impacts having an energy content lying above an, if necessary, adjustable limit value.

4. The device according to claim 1, wherein the integrator circuit connected after the evaluating circuit is constructed as a counter which counts the signals of the evaluating circuit, which signals correspond with those impacts, the rising and dropping speed of which exceeds an, if necessary, adjustable limit value.

5. The device according to claim 1, wherein the integrator circuit connected after the evaluating circuit is formed by a divider and at least one counter connected after said divider, which counter is connected to an indicating unit and can be read into said unit.

6. The device according to claim 5, wherein the divider is connected to two parallel connected counters which can be connected through a selector switch selectively with the indicating unit such that one of the counters can be reset with the manually operable switching device which is assembled with said counter and is constructed as a key and the other counter is connected with a digital comparator, the second input of which is connected to a digital limit-value transmitter and the output of which is connected to a control indicator.

* * * * *